United States Patent [19]

Kuhn, II

[11] Patent Number: 4,649,607

[45] Date of Patent: Mar. 17, 1987

[54] APPARATUS FOR MAKING EXPANDED METAL

[75] Inventor: James A. Kuhn, II, San Jose, Calif.

[73] Assignee: FMC Corporation, Chicago, Ill.

[21] Appl. No.: 749,842

[22] Filed: Jun. 28, 1985

[51] Int. Cl.[4] ..... B21D 31/04

[52] U.S. Cl. ..... 29/6.1

[58] Field of Search ..... 29/6.1; 219/6.5, 10.41

[56] References Cited

U.S. PATENT DOCUMENTS

| | | | |
|---|---|---|---|
| 768,946 | 8/1904 | Malone | 29/6.1 |
| 1,036,173 | 8/1912 | Arey | 29/6.1 |
| 1,526,769 | 2/1925 | Bradford | 29/6.1 |
| 1,544,269 | 6/1925 | Naugle et al. | 29/6.1 |
| 1,845,980 | 2/1932 | Kessler | 29/6.1 |
| 2,104,249 | 1/1938 | Vass | 29/6.1 |
| 3,715,556 | 2/1973 | Balzer et al. | 219/10.41 |
| 4,289,944 | 9/1981 | Reese | 219/10.41 |
| 4,321,444 | 3/1982 | Davies | 219/10.41 |

OTHER PUBLICATIONS

Portion of Niles Expanded Metal—Catalog Dated 1983 including pp. 2 and 4–6.

Single page, No. 0401 from unidentified publication entitled "Expanded Metal".

Single page, No. 1262 from an unidentified publication entitled "Carbon Steel Ornamesh".

Single page No. 1415 from an unidentified publication.

*Primary Examiner*—Howard N. Goldberg

*Assistant Examiner*—Steven Nichols

*Attorney, Agent, or Firm*—A. J. Moore; H. M. Stanley; R. B. Megley

[57] ABSTRACT

A method and apparatus is disclosed for forming upstanding expanded metal from high carbon steels or high carbon alloy steels. The steel is induction heated to a hot forging temperature prior to being formed into expanded metal, and the expanded metal may thereafter be hardened to a hardness greater than that of the base metal from which it was made.

2 Claims, 16 Drawing Figures

FIG_10
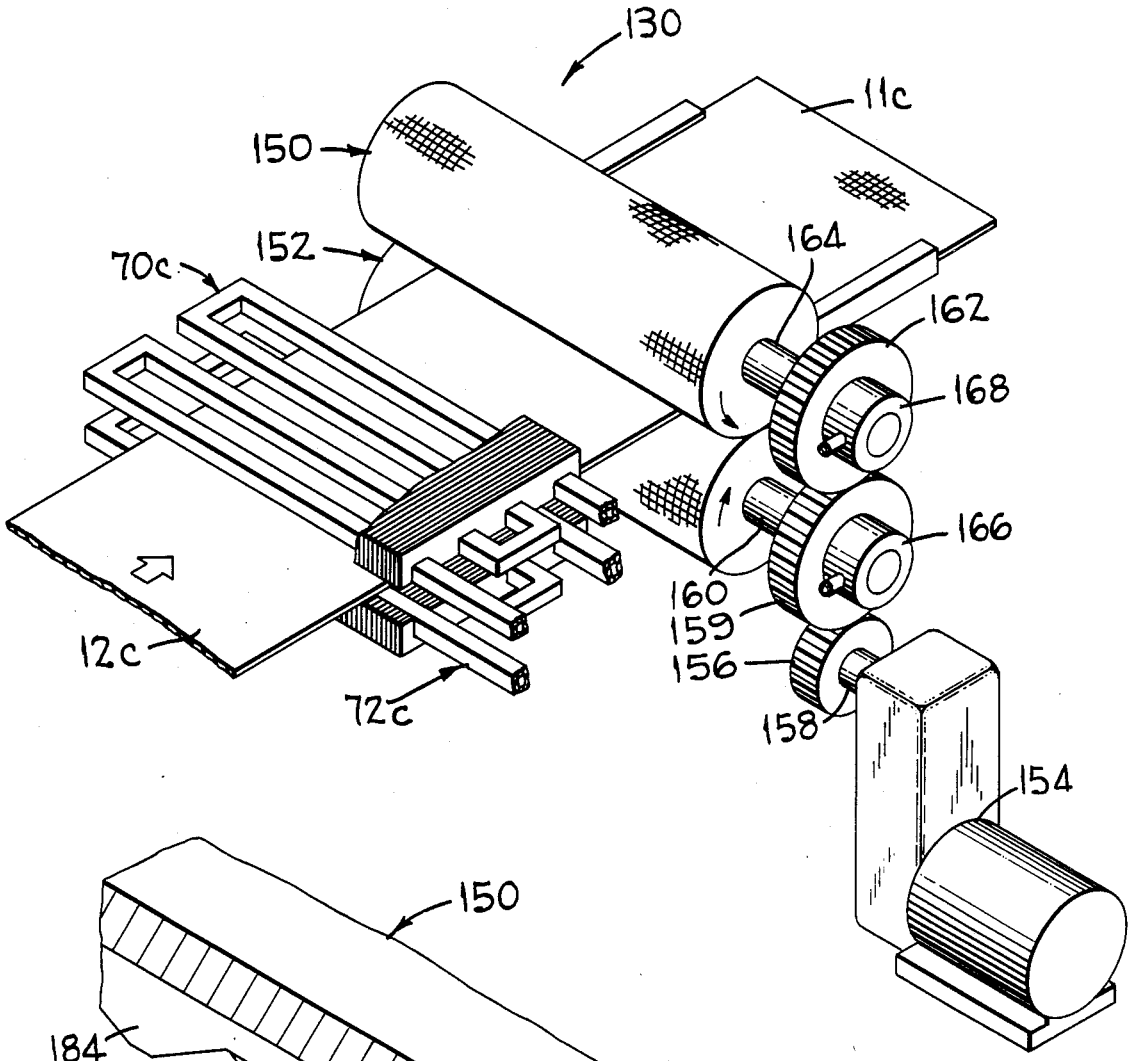
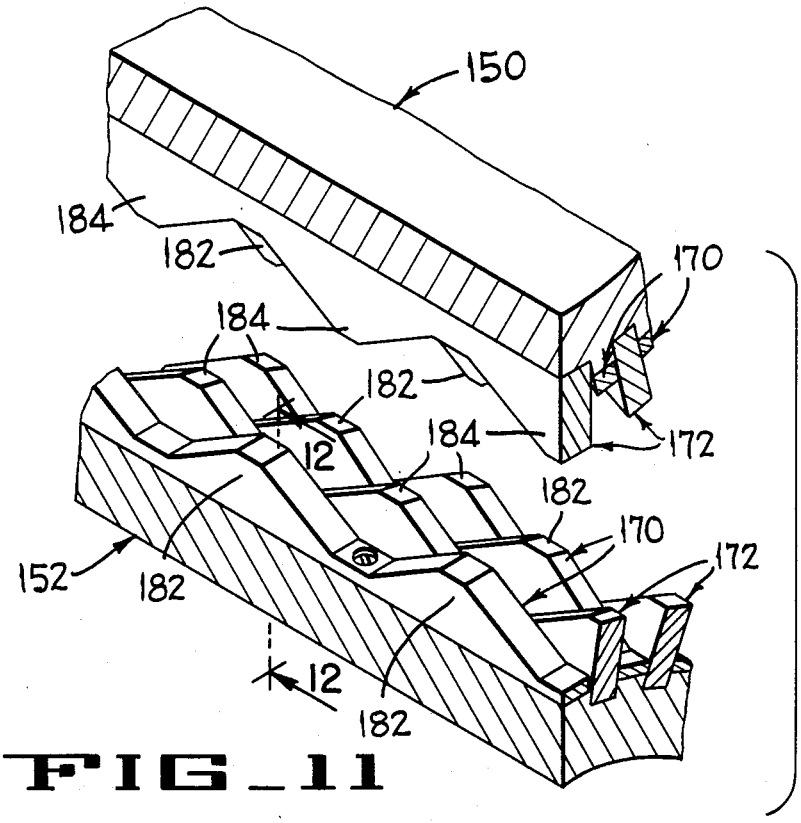
FIG_11

FIG_12
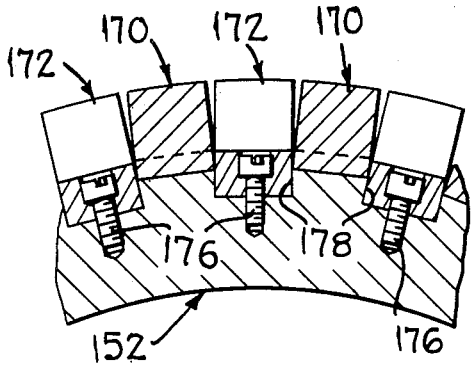
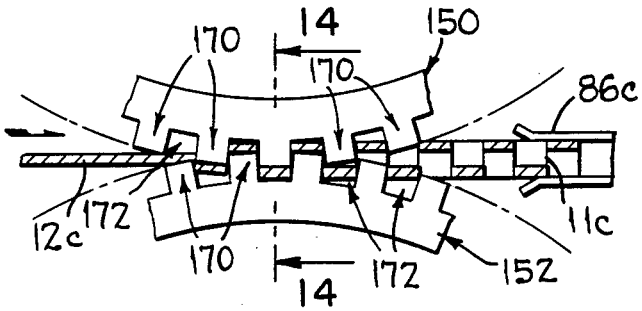
FIG_13
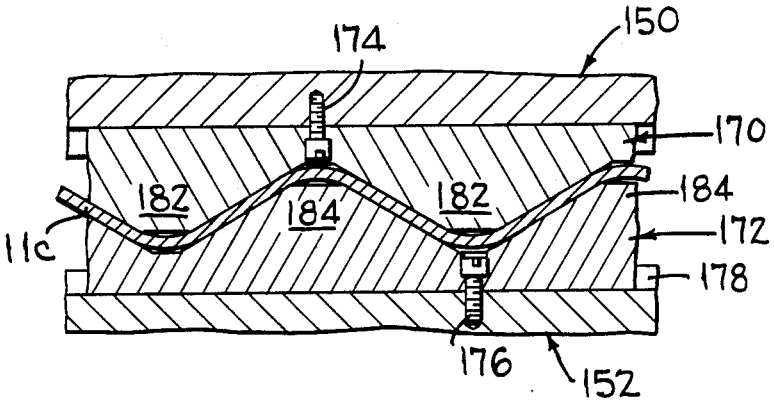
FIG_14
FIG_15
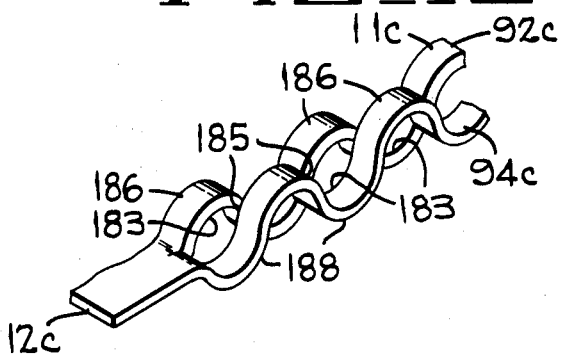

APPARATUS FOR MAKING EXPANDED METAL

BACKGROUND OF THE INVENTION

The present invention pertains to producing expanded metal, and more particularly relates to method and apparatus for forming standard expanded metal from high carbon and alloy steels after heating the steel.

SUMMARY OF THE INVENTION

The present invention discloses a method and apparatus for forming standard expanded metal from high carbon steels or high carbon alloy steels such as steels having the hardness characteristics of AISI 4355, 4340, 4130 and 4140 while heating the steel to a forging temperature immediately before being formed into the expanded metal configuration.

BRIEF DESCRIPTION OF THE DRAWINGS

FIG. 10 is a diagrammatic perspective of a second embodiment of the invention illustrating a cooperating pair of rollers each including a plurality of staggered expanding dies.

FIG. 11 is an enlarged perspective of the two rollers illustrating the manner in which the dies are staggered for making expanded metal.

FIG. 12 is an enlarged section taken along lines 12—12 of FIG. 11 illustrating the manner in which the staggered dies are secured to the rollers.

FIG. 13 is a diagrammatic operational view in side elevation illustrating the manner in which the dies cooperate to from stand-up expanded metal.

FIG. 14 is a section taken along lines 14—14 of FIG. 13 illustrating the steel plate forming one strand into its expanded metal configuration.

FIG. 15 is a diagrammatic perspective illustrating a sinuous steel plate having a planar side portion with two strands of expanded metal connected thereto and connected together at intermediate points.

DESCRIPTION OF THE PREFERRED EMBODIMENT

An expanded metal shear type mechanical press 10 (FIGS. 1-3) of the present invention is designed for making standard expanded metal also known as "stand-up" expanded metal 11 (FIG. 7) from workpieces of high carbon steel 12 and more particularly from alloy steels having hardenability characteristics similar to AISI 4355, AISI 4140 or other hard steels.

Figure 1:
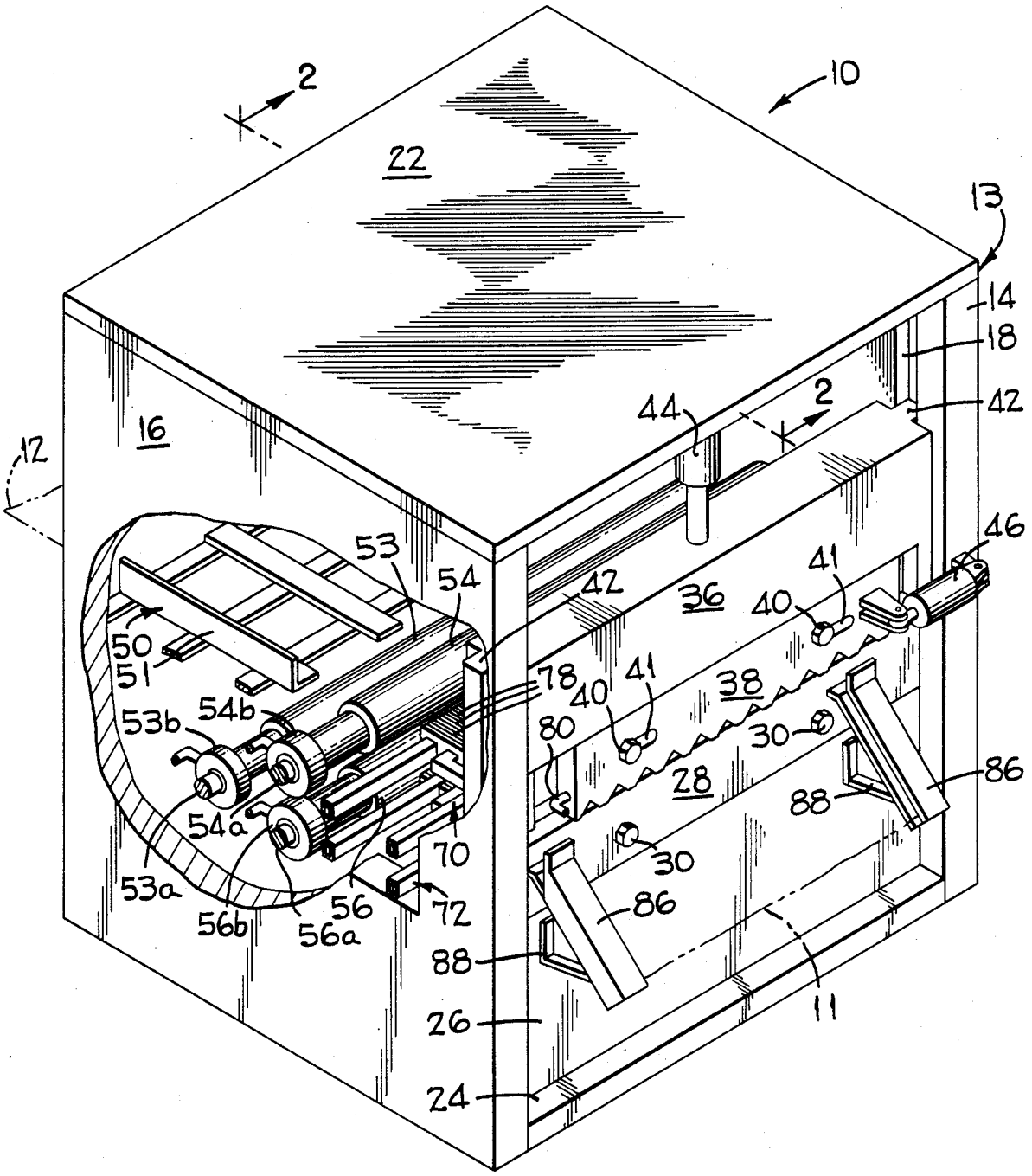
FIG. 1 is a simplified diagrammatic perspective of a first embodiment of the invention illustrating a press for forming expanded metal, certain parts being cut away.
Figure 3:
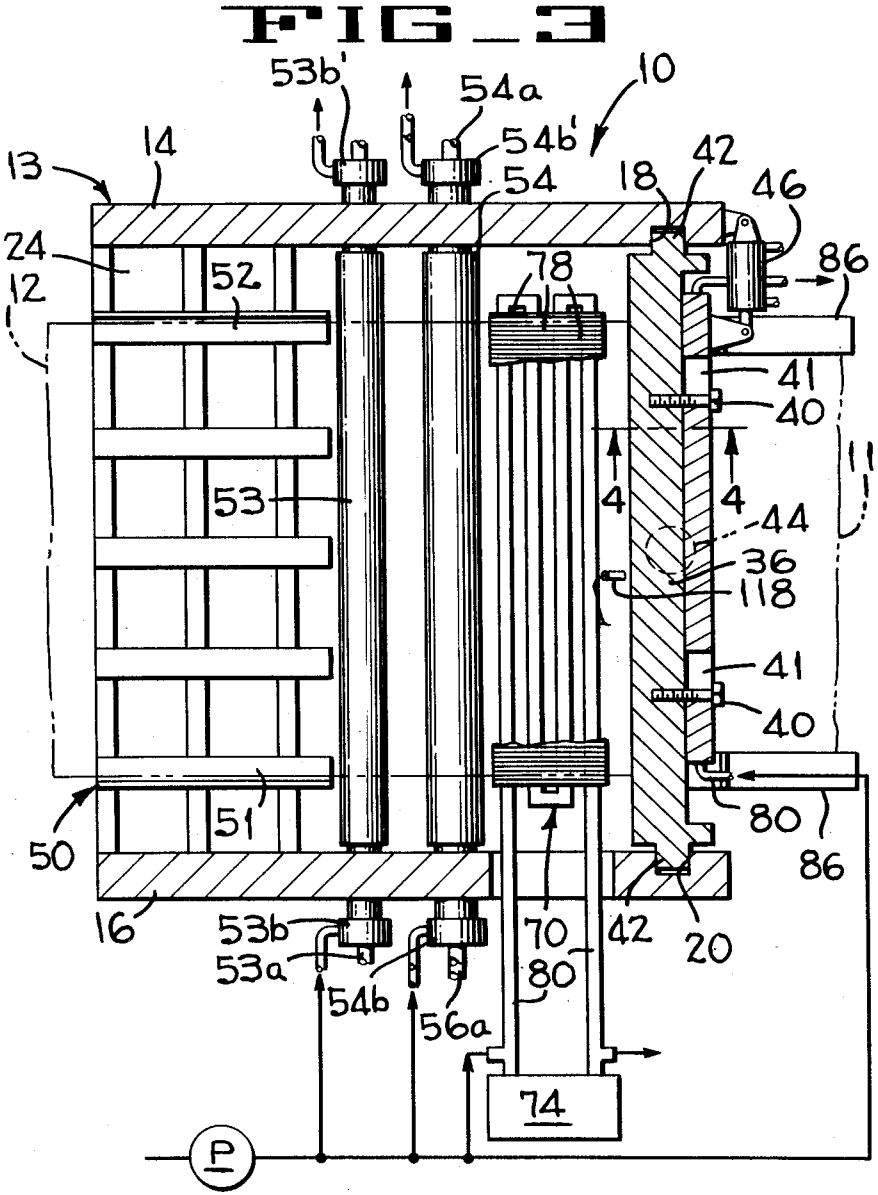
FIG. 3 is a horizontal section taken along lines 3—3 of FIG. 2.
Figure 2:
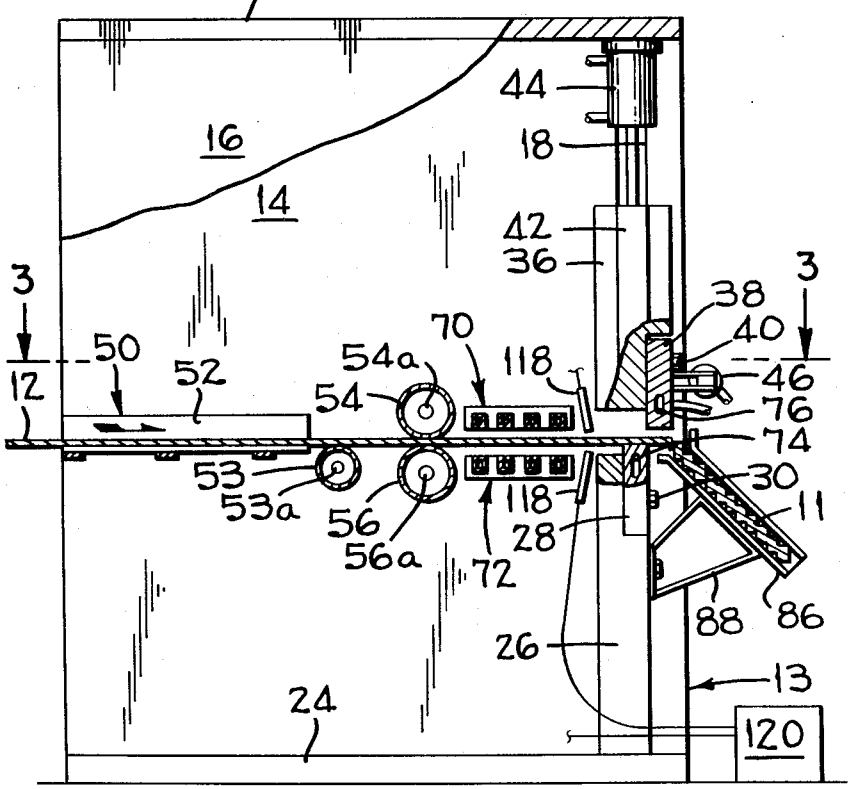
FIG. 2 is a vertical central section taken along lines 2—2 of FIG. 1.

As diagrammatically illustrated in FIGS. 1-3, the press comprises a frame 13 having side walls 14,16 with U-shaped vertical grooves 18,20 therein. A cover plate 22 and floor plate 24 are secured to the side walls 14,16 as by bolting to provide rigidity to the frame 13. A lower front support 26 is bolted to the side walls 14,16 and is notched to receive a shear die 28 that is connected to the support 26 by cap screws 30. A ram block 36 is notched to receive an expanding die 38 therein which is connected to the ram block 36 by cap screws 40 that extend through horizontal slots 41 (FIG. 5) thus permitting the expanding shear to be intermittently reciprocated horizontally a predetermined amount while making the stand-up expanded metal 11. The ram block 36 is provided with rectangular slides 42 on opposite ends thereof which are received in the U-shaped grooves 18,20 to accurately guide the ram block 36, and thus the expanding die 38 for vertical movement. As diagrammatically illustrated in FIGS. 1-3, an expanding die moving means is disclosed and includes a first hydraulic ram 44 which is mounted between the ram block 36 and the cover plate 22 for reciprocating the ram block 36 and its expanding die 38 vertically. A second hydraulic ram 46 of the die moving means is connected between the ram block 36 and the expanding die 38 to reciprocate the die horizontally for a purpose which will be explained hereinafter.

In order to support and advance the workpiece or steel plate between the shear die 28 and expanded die 38, a feed table 50 is mounted to the side walls 14,16 and includes angle guides 51,52 to guide the longitudinal edges of the workpiece 12. A first guide roll 53 is journaled to the side walls 14,16 below the workpiece to guide the workpiece or plate 12 between a pair of pinch rolls 54,56 which advances the workpiece between the dies 28,38 one strand width at a time in timed relation with the vertical and horizontal movement of the expanding die 38.

Although diagrammatically illustrated, the press 10, as thus far described, is substantially similar in function to prior art presses such as a 350 ton shear press, scissors type, McKay mechanical press with a two-stage oscillating ram and a sheet roll feed system or other type feed system. The McKay press is manufactured by McKay Manufacturing Co. Inc. located in Wyoming, MN 55092. It will be understood, however, that the McKay press successfully makes expanded metal from ¼ inch or 3/16 inch low carbon steel such as AISI 1020 but cannot successfully make expanded metal from high carbon steels or high carbon alloy steel such as 3/16 inch or ¼ inch AISI 4355, AISI 4140 or other hard steels without the aid of the inventive subject matter of the present invention as will be described below.

Figure 2A:
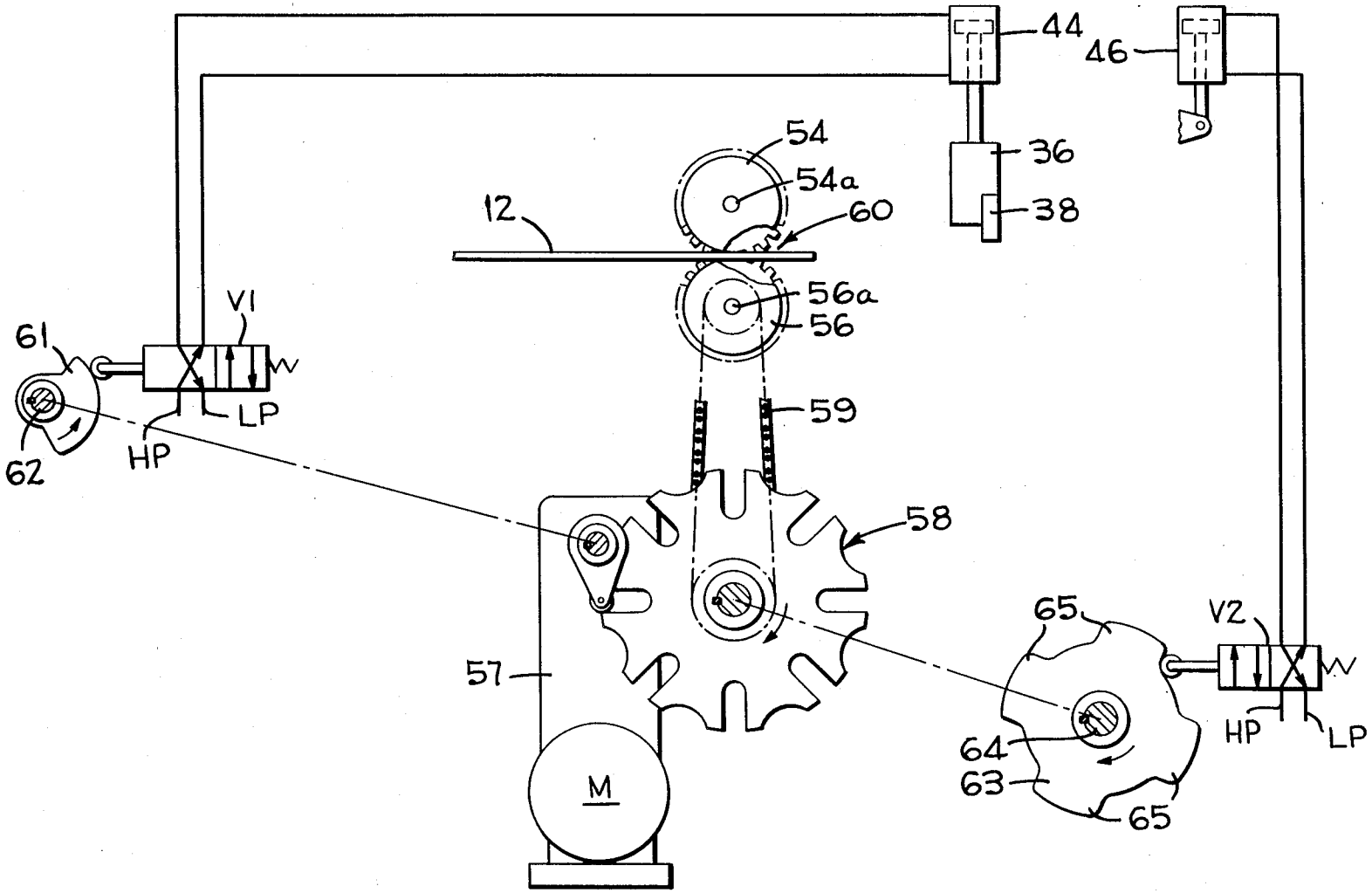
FIG. 2A is a diagrammatic illustration of the intermittent roll drive and controls for the expanding rams.

As diagrammatically illustrated in FIG. 2A, the pinch rolls 54,56 are driven by a conventional motor M and reduction gear box 57 which is connected to a conventional Geneva drive 58 that intermittently drives the lower pinch roll 56 through a chain drive 59. The lower pinch roll shaft 56*a* is connected to the upper pinch roll shaft 54*a* by a gear drive 60.

The hydraulic rams 44 and 46 are activated in timed relationship with each other by a hydraulic system having a high pressure line HP and a low pressure line LP. The lines are connected to a spring return four-way valve V1 which is actuated by a cam lobe 61 connected to a continuously driven shaft 62 of the Geneva drive 58. As illustrated, the cam lobe 61 contacts and shifts the valve V1 to its cross passage position immediately before the intermittently driven portion of the Geneva driver starts to index one tooth thereby raising the expanding die 38 above the path of movement of the plate 12 and remains in the cross passage position until shortly after the indexing system is completed and is then spring urged into its parallel passage position thus forceably lowering the expanding die 38 into its operative position.

The second or die shifting ram 46 is controlled by a second spring return four-way valve V2 which is connected to the high pressure and low pressure lines HP,LP. The core of the valve V2 is alternately moved between its cross passage position and parallel passage position by a cam 63 secured to the intermittently driven shaft 64 of the Geneva drive. As shown in FIG. 2A, the valve spring maintains the core of the valve V2 in its cross passage position against one of four low portions of the cam 63. When the cam 63 indexes ⅛ of a revolution, the valve core will be shifted to its parallel passage position by one of four lobes 65 and will remain in the parallel passage position until the cam 63 is again rotated another step causing the valve core to return to its cross passage position. Thus, the ram 46 will alternately shift the expanding die 38 from the left side (as illustrated in FIG. 3) to the right side of the apparatus 10 for each indexing movement of the Geneva drive.

Figure 5:
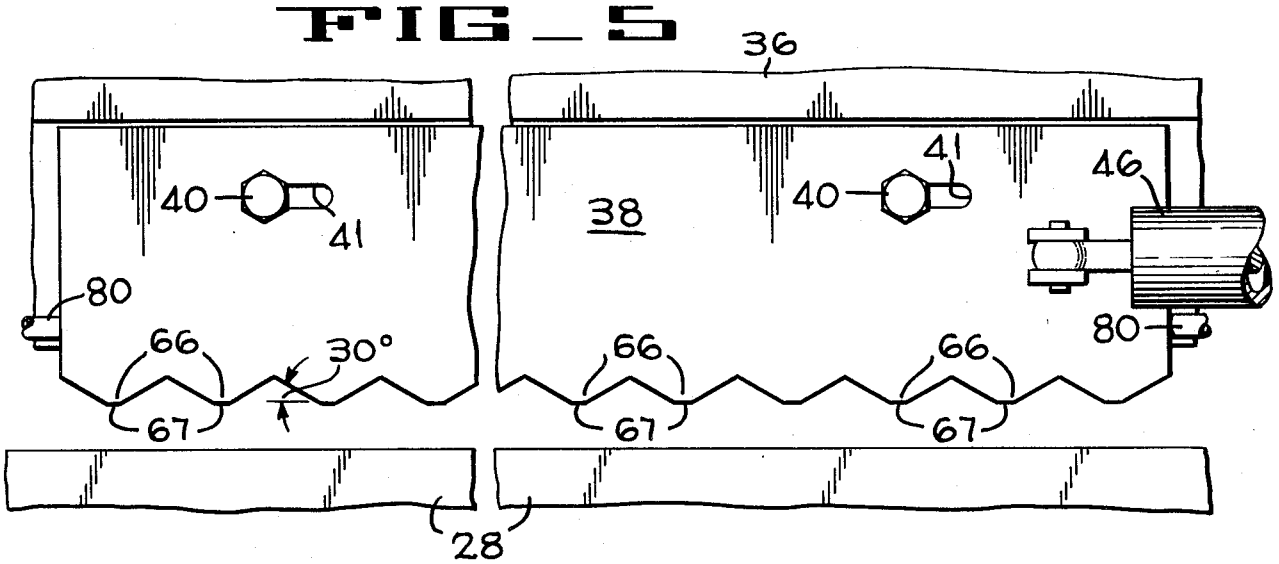
FIG. 5 is a side view of a fragment of the expanding die and shear die showing the configuration of the expanding edge and slots for permitting transverse movement thereof.
Figure 6:
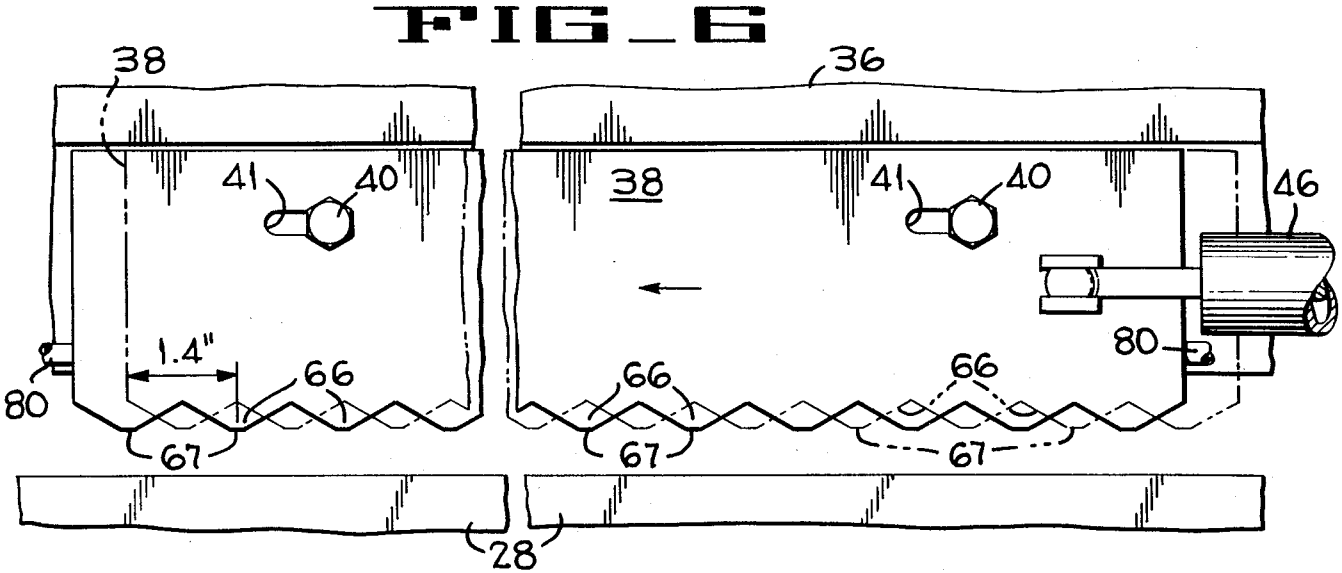
FIG. 6 is an enlarged elevation of a portion of the stationary lower shear die and transversely and vertically movable upper expanding die shown in two operative positions, a portion of the dies being cut away.
Figure 4:
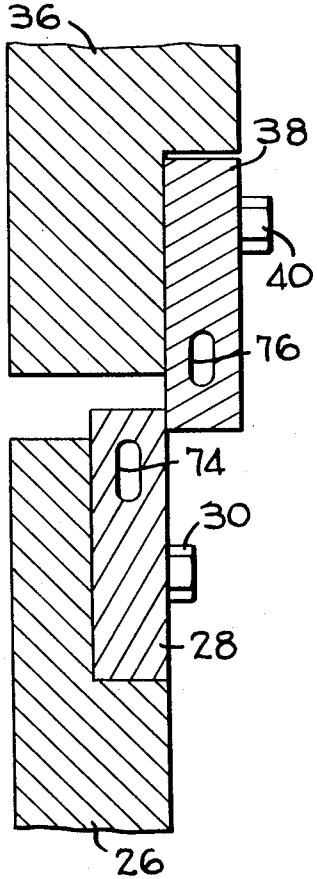
FIG. 4 is an enlarged section taken along lines 4—4 of FIG. 3 illustrating an expanding die and a shear die in position to partially shear the plate.

The configuration of expanding die 38 and its relationship with the shear die 28 is best illustrated in FIGS. 4–6. When designed to handle ¼ inch or 3/16 inch high carbon or alloy steel plates, the expanding die 38 has a plurality of teeth 66 with the low points defined by ¼ inch flats 67 measured longitudinally of the dies which are about 1¼ inch thick. The center to center spacing between the low points is about 1.4 inch, and the angle between the edges of the flats and the low points of the teeth are about 30° from the planes of the flats 67. The high points of the teeth 66 are likewise spaced about 1.4 inches apart, with a maximum radius of about 1/16 of an inch of the apex 66.

An important feature of the invention is to provide means for heating the steel plate 12 to a desired warm or hot forging temperature immediately before the leading end of the steel plate moves between the expanding die 36 and shear die 28. For this purpose, an induction coil 70 (FIG. 1) is positioned above the steel plate 12 between the expanding die 38 and the pinch roll 54; and a second induction coil 72 is positioned between the shear die 28 and the lower pinch roll 56. Each induction coil 70,72 is formed from copper tubing, preferably square tubing, and is connected to a transformer 74 (FIG. 3). During operation, a cooling fluid such as water is directed through each induction coil 70,72 in the direction indicated in FIG. 3 by a pump P (FIG. 3).

In order to prevent the shear die 28 and the expanding die 38 from warping due to excessive heat, a cooling fluid is pumped through a passage 74 (FIG. 4) in the shear die 28 and a similar passage 76 in the expanding die 38 by the pump P (FIG. 3) and conduits 80. Similarly, the rolls 53,54 and 56 have tubular axles 53*a*, 54*a*,56*a* secured to the ends thereof which communicate with the hollow interiors of the associated rolls and with conventional swivel joints 53*b*,54*b*,56*b* defining coolant inlets to each roll, and swivel joints 53*b*′,54*b*′ defining coolant outlets for each roll.

Figure 9:
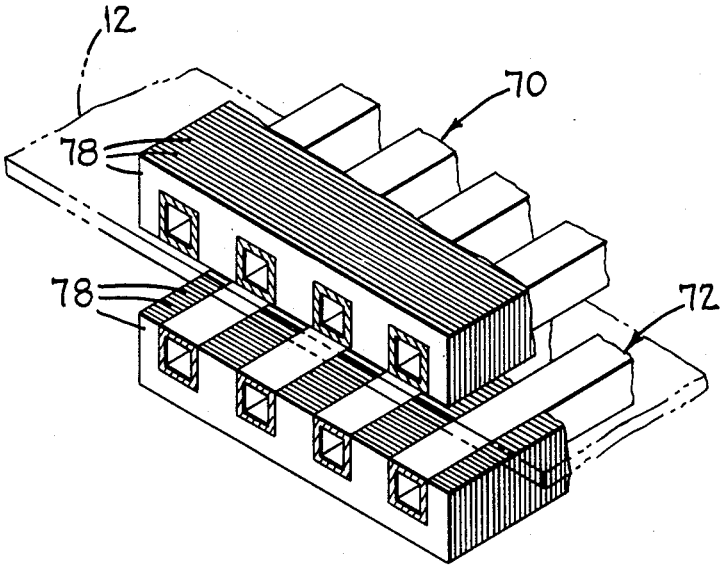
FIG. 9 is a perspective illustrating laminations about the induction coils for more effectively localizing the induction heating.

In the event it becomes necessary or desirable to more effectively concentrate the heat from the induction coils, such as may occur if it becomes desirable to make expanded metal from plates between ⅜ inch to 1 inch thick or larger, laminations 78 may be provided around the coils 70,72 as indicated in FIG. 9. The laminations 78 are preferably formed from silicon steel about 0.007 inches thick and are packed closely together. The laminations serve to concentrate the induced heat.

As illustrated in FIGS. 1 and 2, as the expanded metal 11 is being formed it moves along a path which is angled downwardly. Since the heated metal tends to deflect from a true linear path, channel iron guides 86 may be mounted on brackets 88 connected to the front support 26 in position to engage and straighten the path of movement of the expanded metal 11 without adversely affecting or dulling the sharp sheared edges of the metal, which sharp edges are desired in certain uses of the expanded metal. Alternately, pairs of opposed rollers (not shown) but similar to rollers 54 and 56 may be mounted on the brackets 88 if sharp edges are objectionable since the rollers will slightly flatten the sharp edges of the hot expanded metal.

Figure 7:
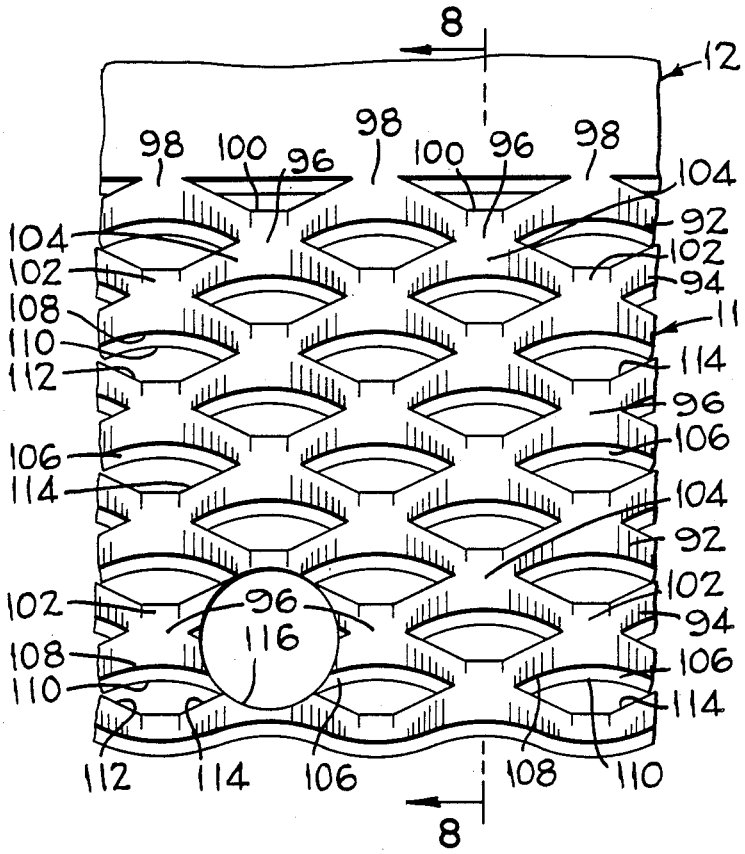
FIG. 7 is a plan view of a fragment of the stand-up expanded metal formed from a high carbon steel.
Figure 8:
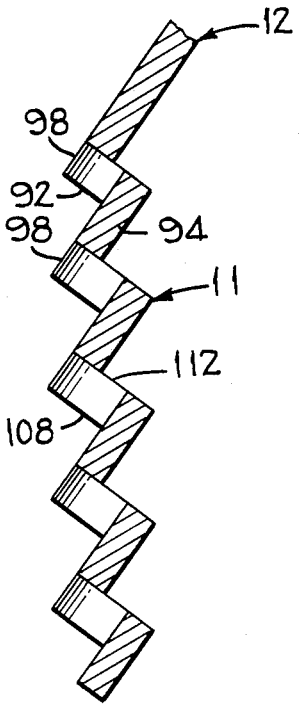
FIG. 8 is a section taken along lines 8—8 of FIG. 7 illustrating a side view of the expanded metal.

As shown in FIGS. 7 and 8, the finished upstanding expanded metal member 11 comprises spaced upstanding strands 92,94 of a monolithic, self contained, piece of metal made by simultaneously cutting and stretching the solid plate of metal so that the resulting up-standing expanded metal member has dimensions greater than the original thus providing metal that is stronger and, as in the present invention, is made harder than that of the original base metal.

As illustrated in FIGS. 7 and 8, the strands 92 are spaced, in part, from the strands 94 but are integral with each other at positions 96. The strands 92 and 94 are sinuous, with the strands 92 having arcuately raised portions 98 and arcuately lower portions 100 therebetween. The strands 94 have arcuate lower portions 102 and arcuate high portions 104. Accordingly, generally diamond shaped holes 106 are formed between adjacent high and low portions of the strands 92,94. Since these holes are sheared from the metal, the sheared edges 108,110, 112 and 114 are quite sharp and are useful in certain applications of the expanded metal.

As indicated in FIG. 7, a mounting hole 116 or the like of any desirable size and shape may be easily formed in the expanded metal 11 when hot by a punch or by dies.

The induction coils 70,72 heat the high carbon or alloy steel workpiece 12 to between about 1600° F. to 2000° F. depending upon the thickness and hardness of the plate to be made into expanded metal 11. The desired temperature is controlled by a pair of pyrometers 118 (FIGS. 2 and 3) which are used for sensing the temperature to surfaces of the plate 12 being heated. A computer 120 is connected to the pyrometer and is used to analyze the temperature signals and to maintain the temperature of the plate at the desired temperature, preferably about 1100° F.–2200° F. when heating AISI 4355 and AISI 4140 steels.

In operation of the first embodiment of the present invention, a workpiece or plate 12 is placed on the table 50 and is moved between the pinch rolls 54,56. A conventional motor and indexing drive (FIG. 2A) is started to intermittently drive the plate forward in equal increments, the hydraulic ram 44 (or equivalent structure) alternately raises and lowers the ram block 36 and expanding die 38, and the hydraulic ram 46 (or equivalent structure) alternately reciprocates the expanding die horizontally. The pinch rolls 54,56; the vertical and horizontal movement of the upsetting die 38 are all driven in timed relationship to each other as is conventional in the art.

As the steel workpiece 12 is advanced by the pinch rolls, the induction coils 70,72 receive power from the transformer 74 thereby heating the forward portion of the workpiece 12 to the desired temperature between about 1100° F. to 2200° F. During this period, the pump P directs coolant, preferably water, through the induction coils 70,72; through the rollers 52,54 and 56; through the shear die 28 and through the expanding die 38 to cool these components which would otherwise be warped by the high heat to which these components would be subjected. The edges of the expanded metal are then guided downwardly between the channel iron guides 86 to maintain the path of movement of the expanded metal along a linear plane if it is desired the sheared edges of the expanded metal remain sharp after cooling. If it is desired to dull the edges, the expanded metal is moved between a pair of rollers (not shown). During heating, Pyrometers 118 and computer 120 maintain the temperature at the desired level.

Although the apparatus has been described as forming expanded metal from ¼" and 3/16" plates 11, it will be understood that thicker plates such as ⅜" to 1" thick plates may be expanded but that the expanding die 38 and the shear die 28 would necessarily be changed to provide teeth 66 that are spaced further apart and penetrate into the hot metal a greater distance.

A second embodiment of the invention is illustrated in FIGS. 10–15 and discloses a continuously driven, rotary shear type press 130. Except for a pair of high speed rotary upsetting rolls 150,152, the apparatus is quite similar to that disclosed in the first embodiment of the invention. Accordingly, only the rotary upsetting rolls 150,152 and the components therein will be described in detail. Components that are similar to those described in the first embodiment of the invention will be assigned the same numerals followed by the letter "c".

The use of a rotary shear press could be used for making expanded metal from thin, low carbon steel, but Applicant has no knowledge of such presses being used to make high carbon steels or high carbon alloy steels into expanded metal.

As illustrated in FIG. 10, a plate **12*c* of high carbon steel is moved between a laminated upper induction heating coil 70*c* and a laminated lower induction heating coil 72*c* to heat the forward end portion of the plate 12*c* to a Pyrometer controlled hot forging temperature of between about 1600° F. and 2000° F. depending upon the type of steel being used and the thickness of the plate 12*c*. The heated plate is gripped between the high speed upsetting rolls 150,152 which are driven in opposite directions as indicated by the arrows in FIG. 10 to rapidly move the plate 12*c* therebetween to form expanded metal 11*c*. The rolls 150,152 are driven by a gear motor 154 having a gear 156 on its output shaft 158. The drive gear 156 meshes with a lower gear 159 keyed to a tubular shaft 160 of the lower roll 152; and the gear 159 meshes with a gear 162 secured to a tubular shaft 164 of the upper roll 150. The tubular shafts 160,164 extend through both ends of the associated rolls and are journaled to the frame (not shown) in a manner similar to that of the pinch rolls of the first embodiment of the invention. As in the first embodiment of the invention, swivel joints 166,168 (only one of each being shown) are connected to opposite ends of the tubular shafts 160,164 and are connected to a pump which directs cooling water through the tubular shafts 160,164 and rollers 152,150 to cool the rollers and components connected thereto. The induction heating coils 70*c*,72*c*** are likewise cooled by passing coolant through the coils.

As best shown in FIGS. 11–13, two series of closely spaced expanding dies 170,172 are rigidly secured to the periphery of each roll 150,152 by a plurality of cap screws 174,176 (FIG. 14). The dies 172 are fitted in spaced indexing slots 178 in the peripheries of the rolls 150,152; and the dies 170 are disposed between the dies 172 and are preferably bolted to the outer surface of the roll 150,152 being disposed and indexed in contacting engagement with adjacent dies 172 as best shown in FIG. 13. As shown in FIGS. 11 and 14, the dies 170 and 172 are both of a generally sinuous configuration. However, adjacent dies on the same roll 150 or 152 are out of phase with each other. Each die 170 has a plurality of generally V-shaped teeth 182 while the dies 172 each have V-shaped teeth 184. When cooperating teeth 170,172 are moved into position to engage and expand the heated steel plate **12*c*, the teeth 182 of the die 170 on lower roll 152 receives the teeth 184 of the associated die 172 on the upper roll 150 therebetween. Thus, each set of upper and lower teeth 184 cooperate with an associated set of lower teeth 182 when engaging the steel plate 12*c* to form the associated strand of the heated plate 12*c* into a substantially sinuous shape to define a first sinuous strand of metal. When the next lower die 172 and upper die 170 reach the point of tangency, the teeth are out of phase with the first set of teeth thus engaging and shearing a portion of the second strand of steel at points between the first and second strand creating two strands of expanded metal having generally diamond shaped openings 183 therebetween as best shown in FIG. 15**.

This procedure continues as each set of upper and lower dies move into and out of engagement with the heated plate **12*c*. It will be noted that the teeth on the upper and lower rolls will pull the plate 12*c* therethrough as the expanded metal is being made. It will also be noted that although the teeth 182,184 have flats on their plate engaging end portions, that the strands 92*c*,94*c* of expanded metal will be stretched into curved portions in the general form of adjacent out of phase sine waves as best shown in FIG. 15 with adjacent strands being connected together at 185 which are unsheared areas that lie in the plane of said plate 12*c*. Thus, each strand has generally curved upper portions 186 and curved lower portions 188**.

As in the first embodiment of the invention, a pair of expanded metal channel shaped guides **86*c* (FIG. 13**) may be provided to guide the edges of the hot expanded metal thereby preventing warpage of the metal.

In operation of the second embodiment of the invention, a high carbon steel plate **12*c*** is moved between the induction heating coils that heat the forward end of the plate to a hot forging temperature between about 1100°

F. to 2200° F. The motor 154 rapidly drives the rolls 150,152 in the direction indicated by the arrows in FIG. 10. Engagement of the teeth 182,184 on the upper and lower rolls 150,152 will pull the plate 12*c* between the rolls and will partially shear surfaces of the plate 12*c* (FIG. 15) to form strands 92*c*,94*c* which are connected together at 185 forming expanded metal 11*c*. The channel guides 86*c* will maintain the hot expanded metal in planar configuration without dulling the sheared portions of the expanded metal. During operation, cooling water is directed in and through the induction coils 70*c*,72*c* and through the swivel joints 166,168 and rolls 160,164 to cool these components in a manner similar to that described in regard to the first embodiment of the invention.

The expanded metal may then be hardened, if desired, by well known hardening procedures. If AISI 4355 is used, it may be hardened to a Rockwell hardness of about RC 54; and if AISI 4140 is used, it may be hardened to a Rockwell hardness of about RC 45 for certain intended uses.

Although the preferred heating means is with induction coils, it will be understood that a furnace of flame heating, and other types of heating may be used.

From the foregoing description it is apparent that two embodiments of a method and apparatus are disclosed for forming up-standing expanded metal from hard, high carbon steels or high carbon alloy steel plates which must be heated to a hot forging temperature before the steel plates can be formed into expanded metal. After being formed into expanded metal, the expanded metal may be hardened to a hardness greater than that of the plate from which it is made.

Although the best mode contemplated for carrying out the present invention has been herein shown and described, it will be apparent that modification and variation may be made without departing from what is regarded to be the subject matter of the invention.

What is claimed is:

1. An apparatus for making "stand-up" expanded metal from the forward end of a hard alloy steel plate having a thickness of between about 3/16 to 1 inch and having a Rockwell hardness between about RC 45 and RC 54 after being formed into expanded metal comprising:

means defining a first die having a sinuous plate engaging surface with two parallel first shearing edges with one first shearing edge lying in at least one shear plane;

means defining a second die having a second plate engaging surface opposing said first die means when in engagement with the plate and having two parallel second shearing edges with one second shearing edge lying in said at least one shear plane when the steel plate is being sheared into "stand-up" expanded metal;

stationary induction heating means having induction coils disposed above and below the steel plate only at a location immediately adjacent said first and second die means for induction heating the forward end portion of the plate to a hot forging temperature of between about 1100° F. and 2200° F.;

means for advancing the forward end of said plate a predetermined distance along a linear path into said shear plane and after the forward end of the steel plate has been partially sheared to define a portion of the "stand-up" expanded metal, said advancing means moving the portion of the expanded metal away from said shear plane; and means for establishing relative movement between said dies in timed relationship with said advancing means for partially severing a strand of expanded metal from the leading end of the plate which strand extends transversely of said path from said one end of said plate is simultaneously formed into a sinuous shape transversely of said path;

said advancing means and said relative movement means cooperating to partially shear additional transverse strands from the forward end of the plate for forming the additional strands into sinuous shapes with adjacent strands interconnected to each other and having sinuous shapes that are out of phase with the adjacent strands and define sharp cutting edges and curved upper and lower surfaces.

2. An apparatus according to claim 1 wherein said first die means comprises a plurality of spaced teeth having flat portions which first engage the hot steel plate, each of said teeth including planar portions which angle away from both sides of said flat portions at about 30°, the center-to-center distance between the teeth being about 1.4 inch when said plate is between about 3/16 to ¼ of an inch thick.

* * * * *